US011554839B2

(12) United States Patent
Chitwood et al.

(10) Patent No.: US 11,554,839 B2
(45) Date of Patent: Jan. 17, 2023

(54) METHOD TO INSTALL, ADJUST AND RECOVER BUOYANCY MATERIAL FROM SUBSEA FACILITIES

(71) Applicant: Safe Marine Transfer, LLC, Houston, TX (US)

(72) Inventors: James E. Chitwood, Spring, TX (US); Art J. Schroeder, Jr., Houston, TX (US); Tom A. Gay, Houston, TX (US)

(73) Assignee: SAFE MARINE TRANSFER, LLC, Houston, TX (US)

( * ) Notice: Subject to any disclaimer, the term of this patent is extended or adjusted under 35 U.S.C. 154(b) by 0 days.

(21) Appl. No.: 17/656,786

(22) Filed: Mar. 28, 2022

(65) Prior Publication Data

US 2022/0219794 A1 Jul. 14, 2022

Related U.S. Application Data

(62) Division of application No. 16/645,622, filed as application No. PCT/US2018/027594 on Apr. 13, 2018, now Pat. No. 11,319,040.

(60) Provisional application No. 62/485,598, filed on Apr. 14, 2017.

(51) Int. Cl.
*B63C 7/10* (2006.01)
*B63C 7/12* (2006.01)

(52) U.S. Cl.
CPC ..... *B63C 7/10* (2013.01); *B63C 2007/125* (2013.01)

(58) Field of Classification Search
CPC .... B63C 7/00; B63C 7/06; B63C 7/10; B63C 7/08; B63C 7/12; B63C 2007/125; B63B 27/00; B63B 27/19; B63B 3/13; E02B 17/00
USPC ..... 114/44, 50; 414/137.7; 405/195.1
See application file for complete search history.

(56) References Cited

U.S. PATENT DOCUMENTS 4,482,590 A * 11/1984 Bouley ..... B63B 3/13 428/313.5
8,992,127 B2 * 3/2015 Joensen ..... B63C 11/00 405/205

* cited by examiner

*Primary Examiner* — Daniel V Venne
(74) *Attorney, Agent, or Firm* — Osha Bergman Watanabe & Burton LLP

(57) ABSTRACT

A system and process for removing rigid unconsolidated buoyancy material from a subsea facility, disposing rigid unconsolidated buoyancy material to a subsea facility, and recovering said rigid unconsolidated buoyancy material for reuse.

15 Claims, 3 Drawing Sheets

METHOD TO INSTALL, ADJUST AND RECOVER BUOYANCY MATERIAL FROM SUBSEA FACILITIES

BACKGROUND

Subsea buoyancy materials used in the deployment and recovery of subsea equipment are expensive, especially when utilized only once and/or in large volumes for deepwater applications. U.S. Pat. No. 7,500,439 and U.K. Patent No. GB2427173 disclose processes which uses fine microspheres that are contained within a buoyant fluid. The buoyant fluid is a hydrocarbon such as aliphatic oil, poly alpha olefin, alkyl ester, or vegetable oil, and the microspheres are hollow glass spheres containing a gas. The fine microspheres have a diameter of 10 to 500 microns. The fine microspheres may be considered a potential hazard in the marine environment and regulations are being adopted to control their use unless encapsulated, or totally contained, as part of a larger buoyancy module.

Other types of buoyancy may be consolidated into a rigid matrix and applied externally to an object requiring buoyancy, especially in deepwater applications. The rigid matrix, which may be molded in various sizes and configurations, may be constructed of various polymers, for example. Almost exclusively in high lift applications, this buoyancy material is fitted to an item requiring lift and then is left in place during deployment.

SUMMARY OF THE CLAIMED EMBODIMENTS

In one aspect, embodiments of the present disclosure relate to a system for removing rigid unconsolidated buoyancy material from a subsea facility, disposing rigid unconsolidated buoyancy material to the subsea facility, and recovering said rigid unconsolidated buoyancy material for reuse, the subsea facility includes a buoyancy containment vessel. The system includes an inlet riser assembly fluidly connected to the side of the buoyancy containment vessel for injecting a mixture comprising seawater and the rigid unconsolidated buoyancy material laterally into the buoyancy containment vessel, and an outlet riser assembly fluidly connected to the top of the buoyancy containment vessel for recovery of the rigid unconsolidated buoyancy material vertically from the buoyancy containment vessel. The system also includes one or more exit ports providing fluid communication between an external environment and the internal volume of the buoyancy containment vessel, and a separation unit located on a workboat or a host facility for separating the rigid unconsolidated buoyancy material from seawater.

In one or more embodiments, the buoyancy containment vessel has a conical top, and includes one or more guides located within the buoyancy containment vessel configured to route the rigid unconsolidated buoyancy material to a top outlet of the buoyancy containment vessel. The rigid unconsolidated buoyancy material is a plurality of macrospheres of a common shape and overall diameter, or a plurality of macrospheres having different overall diameters.

In one or more embodiments, the inlet riser assembly has an internal diameter of 1.2 to 1.8 times a largest diameter of the rigid unconsolidated buoyancy material, when the macrospheres have common shape and overall diameter. In other embodiments, the inlet riser assembly has an internal diameter of 2.0 to 3.0 times the diameter of the rigid unconsolidated buoyancy material, when the macro spheres have different overall diameters is used. The outlet riser assembly has the same, or different, internal diameter as the inlet riser assembly.

The system further includes a pump for pumping a mixture of seawater and rigid unconsolidated buoyancy material down the inlet riser assembly and into the buoyancy containment vessel, and a venturi assembly fluidly connected between an outlet of the buoyancy containment vessel and the outlet riser assembly.

In other embodiments disclosed herein is a method of transporting a subsea facility having at least one buoyancy containment vessel and at least one liquid storage tank, between a sea floor and a sea surface. The method includes disposing a plurality of rigid unconsolidated buoyancy material in the at least one buoyancy containment vessel, adjusting an amount of rigid unconsolidated buoyancy material in the at least one buoyancy containment vessel to increase or decrease a buoyancy of the subsea facility or portion thereof. The number of the rigid unconsolidated buoyancy material added or removed from the buoyancy containment vessel is counted or measured.

In one or more embodiments, the step of disposing includes flowing a volume of seawater and rigid unconsolidated buoyancy material into the buoyancy containment vessel, separating at least a portion of the seawater from the rigid unconsolidated buoyancy material, and discharging the separated portion of the seawater. The unconsolidated buoyancy material floats to the top of the buoyancy containment vessel while the seawater is discharged through one or more exit ports.

In one or more embodiments, the step of adjusting includes flowing an amount of unconsolidated buoyancy material into the buoyancy containment vessel to increase the buoyancy, and flowing an amount of unconsolidated buoyancy material out of the buoyancy containment vessel to decrease the buoyancy. The amount of unconsolidated buoyancy material flowing into and out of the buoyancy containment vessel may be counted or measured by one or more sensors.

In other embodiments disclosed herein is a method for removing rigid unconsolidated buoyancy material from a subsea facility and recovering said rigid unconsolidated buoyancy material for separation from seawater and reuse. The rigid unconsolidated buoyancy material is stored in a buoyancy containment vessel, routed to an exit through one or more guides located within the buoyancy containment vessel, mixed with seawater in an annular venturi jet pump that is fluidly connected to the exit port, and flowed to a workboat or host facility through a riser assembly fluidly connecting the annular venturi jet pump to the separation unit, where the seawater is separated from the rigid unconsolidated buoyancy material.

In yet other embodiments disclosed herein is a method for disposing rigid unconsolidated buoyancy material to a subsea facility. The rigid unconsolidated buoyancy material is mixed with seawater, pumped through a riser assembly fluidly connecting the workboat or host facility to the subsea facility, added to a buoyancy containment vessel located on the subsea host facility. The seawater is then separated from the rigid unconsolidated buoyancy material and ejected to a subsea environment through an exit port located near a bottom of the buoyancy containment vessel.

The volumetric mixing ratio of seawater to rigid unconsolidated buoyancy material is greater than 1.6, and the velocity of seawater and rigid unconsolidated buoyancy material is 3 to 30 feet per second. The unconsolidated buoyancy material has a diameter in the range of 0.50 to 5.00 inches.

Further, in one or more embodiments, viscosity increasing agent is added to the seawater on the workboat, and viscosity increasing agent is added with additional seawater in the buoyancy containment vessel.

In yet other embodiments disclosed herein is a method of performing subsea well operations. The method includes installing a subsea facility, fluidly connecting the subsea facility directly or indirectly to a subsea well system, transferring fluid to or from the subsea facility and the subsea well system, and recovering the subsea facility.

In one or more embodiments the step of installing includes sinking the subsea facility and lower the subsea facility to the seafloor, adjusting an amount of rigid unconsolidated buoyancy material in at least one buoyancy containment vessel to increase or decrease a buoyancy of the subsea facility or portion thereof, and landing the subsea facility on the seafloor. Further, in one or more embodiments the step of recovering incudes adjusting the amount of rigid unconsolidated buoyancy material in the at least one buoyancy containment vessel to increase the buoyancy of the subsea facility or portion thereof, and raising the subsea facility from the seafloor.

In one or more embodiments, the adjusting includes mixing seawater and unconsolidated buoyancy material, flowing an amount of the unconsolidated buoyancy material into the at least one buoyancy containment vessel to increase the buoyancy, and flowing an amount of unconsolidated buoyancy material out of the buoyancy containment vessel to decrease the buoyancy. The amount of unconsolidated buoyancy material flowing into and out of the buoyancy containment vessel may be counted or measured by one or more sensors.

Other aspects and advantages will be apparent from the following description and the appended claims.

DETAILED DESCRIPTION

Figure 1B:
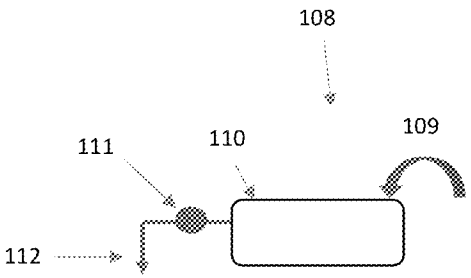
FIG. 1A and FIG. 1B illustrate a system of recovering buoyancy elements according to embodiments of the present disclosure.

Disclosed herein are systems and methods for using loose, recoverable buoyancy elements. Terms such as recoverable buoyancy elements, buoyancy materials, rigid unconsolidated buoyancy material, and buoyancy elements are used herein interchangeably. Loose, recoverable buoyancy elements that are used in embodiments herein may have a diameter of greater than 0.5 inches, such as 1.5 inches or larger, and may be generally spherical in shape. However, buoyancy element shapes are not limited to a spherical shape, as cylindrical, spherocylinder, capsules, or other shapes are also viable for the buoyancy elements, and considered herein. In some embodiments, the buoyancy elements may have effective diameters in the range from 0.5 inches to 6 inches, such as 0.75 inches, 1.0 inches, 1.25 inches, 1.5 inches, 2.0 inches, 2.25 inches, 2.5 inches, 3 inches, 4 inches, or 5 inches, as well as intermediate diameters within the disclosed range. The buoyancy elements used in any particular application may have a uniform diameter (all of a similar size), or may be used in a variety of sizes. In some applications, a mixture of diameters may be used so as to increase a packing density of the spheres during use, thereby providing a maximum buoyancy effect per unit volume.

The buoyancy elements may have an average specific gravity of less than 1, such that they readily float in water or sea water. The specific gravity is considered on a per sphere basis, as embodiments of spheres contemplated herein may include a composite sphere having a rigid outer shell and multiple internal bodies of lower specific gravity. In some embodiments, the buoyancy elements may have an average specific gravity in the range from about 0.5 to about 0.9, such as in the range from about 0.6 to about 0.7.

One or more embodiments herein are directed toward systems and methods for ensuring buoyancy elements are handled in a manner in which they are not let loose in the marine environment and furthermore may be recovered for reuse. Large size loose buoyancy spheres, macrospheres having a diameter greater than 5 mm, may be used to provide buoyancy and for disposing or recovering buoyancy elements from flooded containment tanks attached to subsea facilities. These containment tanks, when filled with the loose buoyancy elements (spheres or other buoyancy elements), provide lift to the facilities to which they are structurally attached. Withdrawal of a portion of the loose buoyancy elements while retaining water within the containment tank may provide for adjustable buoyancy.

One such structure may be a barge-like structure that may support a payload of up to approximately 600 tons of chemicals, slurries, or other liquids, and may support pumps, compressors, or other subsea equipment and infrastructure that are lowered and positioned on the seafloor in a controlled manner. The arrangement of buoyancy tanks may be incorporated into the barge-like structure, such that when the buoyancy tanks are devoid of seawater, or filled with the loose buoyancy elements, the entire structure and payload is able to float on the surface of the water similar to a barge. When the buoyancy tanks are water filled, or lacking sufficient loose buoyancy elements, the volume of tank limits the apparent underwater weight that the hoisting equipment would support as the entire structure and payload transits to or from the water surface and the seafloor. Since these tanks may be partially filled with loose buoyancy elements, variable lift is achieved by simply adding or removing some of the large spheres from the tank.

According to embodiments disclosed herein, the structure may have at least one liquid storage tank, or other subsea equipment, and at least one buoyancy tank. The storage tank may have a rigid outer container and at least one flexible inner container. The at least one inner containers may be, for example, a bladder made of a flexible, durable material suitable for storing liquids in a subsea environment, such as polyvinyl chloride ("PVC") coated fabrics, ethylene vinyl acetate ("EVA") coated fabrics, or other polymer composites. The at least one inner container may be equipped with closure valves that closes and seals-off when the associated inner container fully collapses, which may protect the integrity of the inner containers by not subjecting the inner containers to potentially large differential pressures. Further, while the volume of the at least one inner container is variable, the volume of the outer container remains fixed. The outer container may act as an integral secondary or backup containment vessel that would contain any leak from the inner container, thus creating a pressure balanced dual barrier containment system.

Further, a barrier fluid may be disposed between the annular space between the outer container and the inner container. The barrier fluid may be monitored for contamination, such as contamination from a leak in one of the inner containers. For example, the barrier fluid may be monitored by disposing sensors within the annular space between the outer container and the at least one inner container. According to embodiments disclosed herein, a storage tank may include at least one sensor disposed in the space between the outer container and the at least one inner container. Sensors may be used in the storage tank, for example, to monitor contamination of the barrier fluid, as discussed above, to monitor the volume of the at least one inner container, to monitor temperature and/or pressure conditions, or to monitor other conditions of the storage tank.

The structure having at least one buoyancy tank may be used for payload deployment and recovery, and may also be used as a seafloor foundation for processing and equipment. This foundation may enable the pre-deployment, assembly, testing, and commissioning of such payloads.

Other embodiments disclosed herein are directed toward a system and method of raising and lowering the structure from sea surface to seafloor. In one or more embodiments, the structure may be allowed to sink by adding ballast or decreasing the buoyancy. Once submerged just below the sea surface, the amount of buoyancy elements flowing into and out of the at least one buoyancy tank is monitored, measured, or counted by one or more sensors. This may allow for the structure to remain level while being lowered to the seafloor. As the structure is lowered, buoyancy elements may be added or removed from individual tanks, increasing or decreasing the buoyancy as necessary.

The structure may be recovered from the seafloor and raised back to the sea surface by adding buoyancy elements to the buoyancy tanks to lift the structure off the seafloor. After the structure is just off the seafloor, buoyancy elements may be removed from the buoyancy tanks such that the rate of ascent and the orientation and pitch of the structure are controlled.

The structure, for example, a submerged shuttle as described above, or as described in U.S. Pat. No. 9,079,639, incorporated herein by reference, or a structure with similar buoyancy needs that may have its buoyancy containment tanks filled with an appropriate volume of buoyancy elements. Variable buoyancy may enable adjusting the submerged weight and trim of the facility as it is either installed on or recovered from the seafloor. Final adjustment of the facility's submerged weight may be accomplished while the facilities are at the surface, typically in port prior to initial installation. The entire facility, complete with contained buoyancy elements, may then be placed on the seafloor following an installation procedure, described below. Once the facility is secured on the seafloor, the buoyancy elements may be recovered for reuse.

Removal of part, or all of, the buoyancy elements once the facility is on the seafloor may be used to adjust the on-bottom facility weight to a desired value to prevent movement on the bottom or to achieve other design functions such as an adjustment to level the facility.

The loose buoyancy elements within their containment tanks have a maximum packing ratio of sphere volume to void volume in the tanks of about 75% in some embodiments, a maximum of 58% in other embodiments. The void volume represents the volume in the tank not occupied by the buoyancy elements, which space may typically be occupied by a transfer fluid, such as seawater. The spheres, which may be specified with specific gravities of less than 1.0, may float to the top of the containment tanks and their buoyancy will be pushing all along their pack pathway to the top of the containment tanks. The containment tank top may be shaped as appropriate to funnel or guide the spheres to an exit port in the tank top. Various embodiments of the containment tanks may include funnel shaped inserts at various levels within the tank. It is envisioned at various locations up the side of the containment tank, and possibly at the top, these ports can be connected to a riser pipe or hose which will enable flow of the spheres to float up a flooded riser to the surface. At the surface, such as on a boat or other surface host facility, the buoyancy elements can be collected for reuse. In some embodiments, seawater may be used to facilitate a more rapid removal of the spheres from the containment tank. The buoyancy elements can then be separated from the transfer fluid, such as seawater. Since the transfer fluid is typically clean seawater, it can be simply returned to the sea or disposed of as appropriate.

In one or more embodiments, flowing transfer fluid and buoyancy spheres up the riser pipe may be improved by adjusting the ratio of sphere volume to the transfer fluid volume. Each unit volume of buoyancy elements may need to be accompanied by a minimum of approximately 1.6 unit volumes of transfer fluid, or more. This excess transfer fluid may be required to minimize, or eliminate, bridging of the riser with buoyancy elements or material which may result in plugging of the riser.

In one or more embodiments, the transfer fluid flow velocity in the riser may also be adjusted. This velocity may be adjusted to be greater than the velocity at which the buoyancy element is free to rise in a static fluid column (i.e., transfer fluid velocity is greater than a terminal velocity of the buoyancy element in a static water column). This velocity adjustment can be used to minimize the potential for the buoyancy elements to bunch up which may increase the plugging potential in the riser. For buoyancy recovery, the direction of fluid flow and the floatation or net buoyancy force on the variable buoyancy elements may be in the same direction.

In one or more embodiments, the system for removing rigid unconsolidated buoyancy material (also referred to as buoyancy elements) from a subsea facility may include one or more of: an exit port located near a top of the buoyancy containment vessel, one or more guides located within the buoyancy containment vessel, an annular venturi jet pump fluidly connected to the exit port, a separation unit located on a workboat or a host facility, and a riser assembly that fluidly connects the annular venturi jet pump to the separation unit. The guides may be configured to route the rigid unconsolidated buoyancy material to the exit port. These guides may also help in reducing plugging, or bridging. The annular venturi jet pump may have a throat with a diameter sufficient to allow passage of the rigid unconsolidated buoyancy material. The separation unit may separate the rigid unconsolidated buoyancy material from seawater. These features will be further defined below.

In one or more embodiments, the subsea facility on which the system is disposed may contain a buoyancy containment vessel, and at least one liquid storage tank. The buoyancy containment vessel may be a rigid container, or may be a flexible container.

The rigid unconsolidated buoyancy elements may be selected based on one or more of an operating depth, overall diameter, shape, and integrity. Additionally, the rigid unconsolidated buoyancy material may be a plurality of macro spheres of a common shape and overall diameter, or may be a plurality of macro spheres having different overall diameters. In one or more embodiments where the macro spheres have a common shape and overall diameter, the riser assembly may have an internal diameter of 1.2 to 1.8 times the overall diameter of the rigid unconsolidated buoyancy material. In one or more embodiments where macro spheres having different overall diameters are used, the riser assembly may have an internal diameter of 2.0 to 3.0 times the overall diameter of the rigid unconsolidated buoyancy material.

The above described system may also function to dispose rigid unconsolidated buoyancy material to the subsea facility, and recover the rigid unconsolidated buoyancy material for reuse. FIG. 1 illustrates the major components in this system to recover the buoyancy elements or spheres.

Figure 1A:
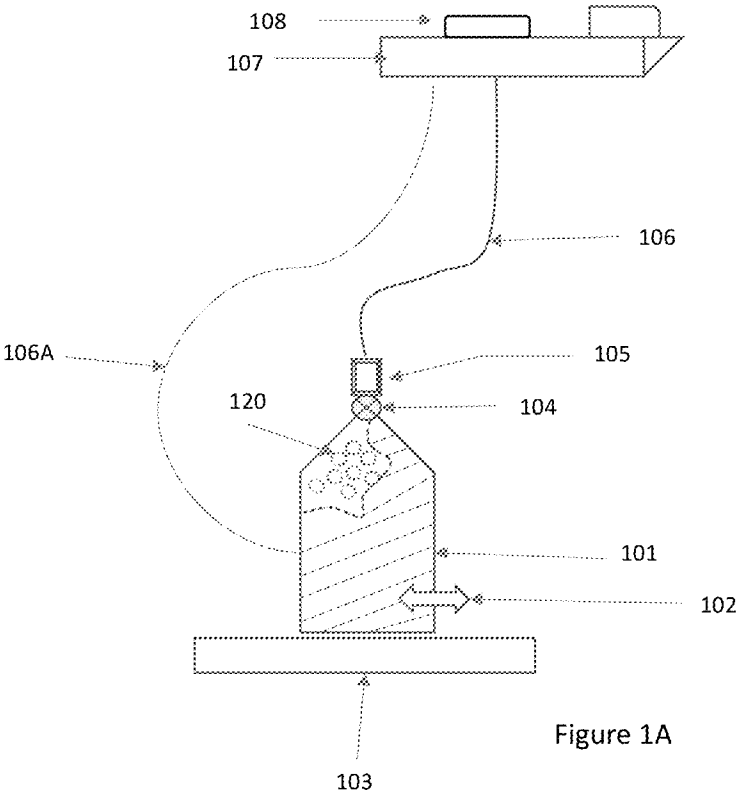

As illustrated in FIG. 1A, buoyancy element containment tank (101) (also referred to as a buoyancy containment vessel) may be filled with seawater and buoyancy elements (120). This tank may have an appropriate shape which funnels the buoyancy elements (120), which may be in the form of floating spheres to one or more exit port valves (104). Seawater enters (or exits) tank (101) through a port (102) that may be equipped with a filtering screen of appropriate design that keeps the buoyancy elements inside tank (101) and marine life out.

Tank (101) may be attached to, or integral with, a subsea facility (103) to which the generated buoyancy lift is added. This tank may be configured in an assortment of shapes all having the common function of retaining the buoyancy elements inside and transferring the buoyancy lift to the attached structure and equipment.

Buoyancy may be provided by multiple tanks (101) on the subsea facility, depending on buoyancy needs and overall design requirements for the subsea facility. Use of multiple tanks will give the ability to have the desired buoyancy and the desired trim and heel (orientation in the water) for the installation, for the seabed weight on bottom, distribution of weight on bottom, level (orientation angles on bottom), and for the recovery to the surface of the subsea facility.

Tank (101) may be equipped with one or more guides within the tank. These guides may be fins or inserts designed to route the buoyancy elements towards the exit port. The guides may be used with the conical shaped tank, or may be omitted. The guides may be designed, and disposed, such that they do not affect the available volume in which the buoyancy elements may be disposed.

Tank (101) may also functionally serve as a separator unit. The separator functionality of the tank may enable buoyancy elements to be collected in the tank while separating and discharging the transfer fluid to the subsea environment.

Further, tank (101) may be equipped with a separate inlet and outlet for the buoyancy elements. As illustrated, buoyancy elements and transfer fluid may be pumped down riser (106A) into the side, horizontally into tank (101) or upward into the bottom of tank (101), each below the midpoint of tank (101). When being filled, exit valve (104) may be closed or restricted so that buoyancy material stays in tank (101). Transfer fluid being pumped down with the buoyancy material may be ejected to the subsea environment through exit port (102). In other embodiments, the tank (101) may not include an exit port (102), and transfer fluid may be ejected through valve (104) for recovery and reuse.

In one or more embodiments, exit port (102) may be a single hole with a diameter of 1 to 20 inches and covered in a mesh. Such a configuration may enable buoyancy elements to be retained within tank (101) while ejecting transfer seawater to the subsea environment, thus allowing tank (101) to act as a separator. Further, the mesh covering exit port (102) may prevent marine life from entering tank (101).

In other embodiments, exit port (102) may be a plurality of holes located in near proximity of each other and each covered in mesh. In such a configuration, each hole may be 1 to 4 inches in diameter. In yet other embodiments, exit port (102) may be a plurality of holes located around the perimeter of tank (102) and each covered in mesh, and each hole may be 1 to 4 inches in diameter. In embodiments where a plurality of smaller holes is used, the mesh covering the holes may be more rigid due to the smaller area covered by the mesh.

In yet other embodiments, exit port (102) may be a plurality of holes with a diameter substantially smaller than the diameter of the buoyancy elements arranged around the perimeter of tank (101). In such an embodiment, a mesh screen may or may not be necessary to keep out marine life.

In one or more embodiments, the entire process to dispose and recover buoyancy elements to and from tank (101) may be handled by riser system (106) without the need for the second riser (106A). In such embodiments, exit port (102) may still be used so that tank (101) can function as a separator, separating the excess transfer fluid from the buoyancy elements.

For buoyancy element recovery, embodiments herein may optionally include a jet pump assembly (105) fluidly connected to the containment tank exit valve (104) and the riser assembly (106) which extends to the sea surface where a workboat (107) supports the riser assembly (106). The riser assembly (106) may, in some embodiments, be a hose, jointed tube, or other suitable piping. The jet pump assembly (105) may, in some embodiments, be connected to a Remote Operated Vehicle (ROV) or an Autonomous Underwater Vehicle (AUV).

In one or more embodiments, a jet pump assembly (105) may not be necessary, and the buoyancy material may be recovered through riser system (106) due to the buoyancy materials natural tendency to float. In embodiments where a jet pump assembly (105) is not used, transfer fluid (seawater) may be pulled into tank (101) through exit port (102) due to the upward rising buoyancy elements.

On the workboat (107), the buoyancy elements may be contained in a buoyancy element handling device, which is part of deck equipment (108). As illustrated in FIG. 1B, transport fluid and buoyancy elements (109) from the riser are flowed into separator tank (110) where the transport fluid may fill the separator to near the top where it routes through a screen and exits the separator tank through valve (111). This clean fluid may then be returned to the sea through an overboard drain (112). The purpose of the separator's inlet is to slow down the velocity of the buoyancy elements and minimize the impact loads between the buoyancy shapes and the separator's structure. The buoyancy elements may float in separator tank (110), thus enabling the buoyancy elements to be recovered for later use.

In one or more embodiments, the riser assembly or hose may be appropriately sized for routing the spheres to the surface while preventing buoyancy spheres (or elements) from bridging in the riser. Typically, the riser's inside diameter should be about 1.5 times the maximum diameter of the buoyancy sphere. This size will enable high flowrates of transport fluid and the spheres being recovered.

Figure 2:
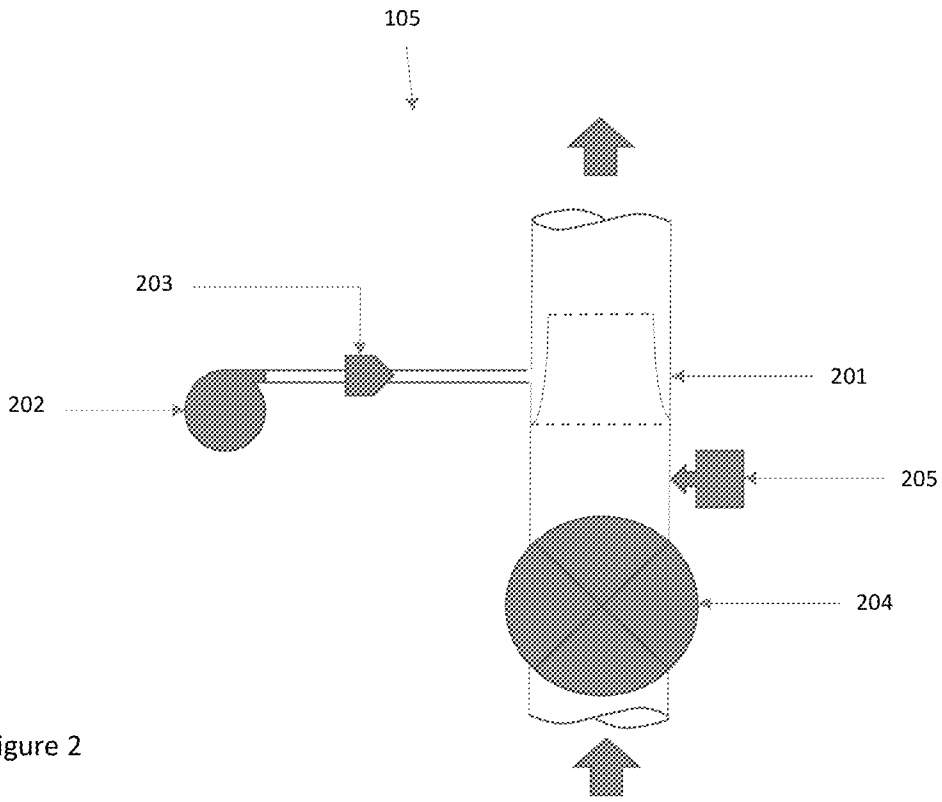
FIG. 2 illustrates an annular venturi jet pump according to embodiments of the present disclosure.

Now referring to FIG. 2, the annular venturi jet pump assembly (105) is illustrated. The annular venturi jet pump assembly (105) may manage the ratio of buoyancy spheres and seawater flowing upward through the riser.

The core of the annular venturi jet pump assembly (105) is the annular venturi pump (201) which has a throat sufficiently large for the passage of the largest sized buoyancy elements disposed within tank (101). Power fluid (for example, seawater) is pumped into the annulus of the venturi through pump (202) and exits under pressure along the walls of the assembly where it entrains the spheres (elements) coming through the throat of the venturi. This may create a jet pump suction and flow to pull the spheres from the containment tank and into the flowing fluids exiting this jet pump into the riser to the surface. In one or more embodiments, the jet pump power fluid and the fluid transporting the buoyancy elements from the containment tank actively mix together in this assembly to become the desired volume or the correct volume ratio for buoyancy transport. This ratio of buoyancy element volume and transport fluid is actively managed by adjusting the output of the pump (202) and by throttling the choke valve (204).

Jet pump power fluid is pumped by a conventional pump (202) which may be ROV mounted, mounted on this assembly, or surface located and attached to this assembly through a separate riser pipe or hose. Before the power fluid enters the venturi, it passes through a flowmeter (203) where its rate is measured to assure the transport fluid volume ratio to the buoyancy material volume is within acceptable limits. In a similar way, there is a sensor (205) that measures the number or volume of buoyancy elements that enter and are pumped by the pump assembly. This direct buoyancy element measurement may enable management of buoyancy element deployment and recovery while directly monitoring the buoyancy element to fluid volume ratio.

Figure 3B:
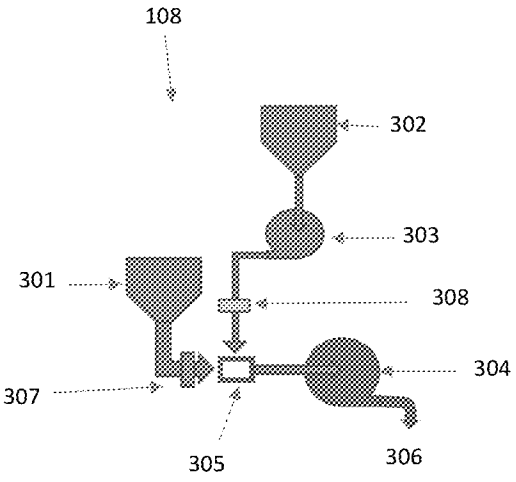
FIG. 3A and FIG. 3B illustrate a system of deploying buoyancy elements according to embodiments of the present disclosure.

In some embodiments, the same general equipment may be used to recover subsea buoyancy elements or may be reconfigured and used to replace the buoyancy elements so the greater integrated subsea facility may be recovered. Possible changes in the configuration are illustrated in FIG. 3A and FIG. 3B.

Figure 3A:
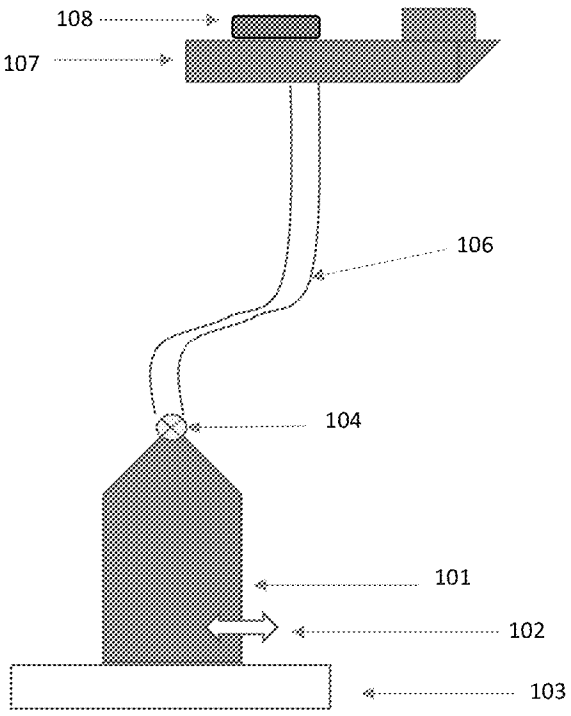

Comparing FIG. 3A to FIG. 1A, the annular venturi Jet pump (105) may be removed from the riser assembly and the riser assembly (106) is connected to the containment tank exit port (104). The deck equipment (108), as illustrated in FIG. 3B, may mix the buoyancy elements and transfer fluid in the correct ratios, and elevate their pressure to greater than the hydrostatic pressure at port (102), which may cause the fluids and buoyancy elements to flow down the riser and into the containment tank (101).

In the containment tank (101) the spheres will float to the top of the tank and the transport fluid will separate and exit the containment tank through the screened port (102). In the replacement operation, placing the spheres in the containment tank, the velocity of the transport fluid may be moving down the riser faster than the sphere's rate of rise through a column of the static transfer fluid. In one or more embodiments, the viscosity of the transfer fluid may be increased by adding a viscosity increasing chemical. Viscosity increasing chemicals and gelling chemicals are common is the petroleum drilling industry. Fortunately, there are viscosity increasing chemicals that are minimal or non-toxic (enabling discharge to the sea) and after a period of time the increase in transfer fluid viscosity degrades and is lost. Referring now to FIG. 3B, in one or more embodiments, on the deck equipment (108) the tank (301) may be used to prepare a mixture of buoyancy elements and transfer fluid. The mixture is fed through a buoyancy element counting detector (307) or other appropriate means to estimate the flow rate of buoyancy elements and into the annular venturi jet pump (305). This jet pump may be powered with a high viscosity transfer fluid from tank (302), pumped with the centrifugal pump (303) that passes through a flowrate meter (308) before entering the jet pump. In this fashion, the ratio of transfer fluid volume to buoyancy element volume may have the correct ratio for flowing down the riser (106) and into the subsea containment tank (101). The annular venturi jet pump (305) may function to pre-charge a suitable high pressure pump (for example, a triplex positive displacement pump or a multi-stage twin disc pump) (304), which may generate the high pressure needed to flow the buoyancy elements and transfer the buoyancy elements into the riser head (306), which connects to the riser (106). This high pressure pump (304) may be sized to pass the largest diameter buoyancy elements.

Subsea buoyancy elements may benefit from its rigid solid elements that minimally change shape/size with a changing hydrostatic environment. This may provide a nearly constant buoyancy lift force unlike compressible buoyancy such as gases (air) or low density fluids (hydrocarbons). Therefore, the ability to place rigid buoyancy elements subsea enables using other buoyancy containment structures in underwater operations. For example, flexible lift bags (like those used by divers) may be deployed in deeper water and filled with rigid buoyancy shapes using the previously described method.

According to one or more embodiments disclosed herein, the system and method described above may have the below attributes or benefits.

Loose or unconsolidated buoyancy elements consisting of macro spheres or other such solid shapes capable of working in high hydrostatic environments may provide the unique buoyancy compatible with recovery operations. They will generally be of common shape and size for efficient handling and recycling. However; a mixture of selected sizes can result in a denser buoyancy pack providing somewhat greater lift efficiency. They are robust to survive the impact forces and loads associated with passage through the buoyancy recovery system.

The subsea buoyancy containment system may be a rigid containment or a flexible containment structure. For buoyancy recovery, these containment structures will have a funneling feature to direct the floating buoyancy shapes into the recovery system, such as including a jet pump and riser.

The annular venturi jet pump may suction the buoyancy elements through the containment exit port. Mixing of the power fluid (typically seawater) with the buoyancy elements enables adjusting the ratio of solid buoyancy volume to the volume of transfer liquid. The ratio minimizes the potential for bridging (plugging) of the riser by the buoyancy elements or other material.

The riser system, which may be rigid pipe, flexible hoses, or combinations thereof, may have a compatible internal diameter with the maximum buoyancy element size and shape. The internal diameter of the riser system may be of sufficient size to prevent or minimize bridging within the riser system. Accordingly, the internal diameter may be selected based on the overall diameter of the buoyancy material. In one or more embodiments the riser system may have an internal diameter greater than about 0.25 inches. In other embodiments, the riser system may have an internal diameter greater than 0.50 inches, greater than 0.75 inches, greater than 1.00 inches, greater than 1.25 inches, greater than 1.50 inches, greater than 1.75 inches, or even greater than 2.00 inches. In one or more embodiments, the riser system may have an internal diameter between 1.25 inches and 4.00 inches. In other embodiments, the riser system may have an internal diameter of between 1.50 and 3.00 inches. In yet other embodiments, the riser system may have an internal diameter between 1.50 and 2.50 inches.

In one or more embodiments, the internal diameter may be on the order of 1.5× the maximum diameter of the buoyancy element for a buoyancy element recovery. In such embodiments, when the buoyancy material has an overall diameter of about 1.50 inches, the riser system may have an internal diameter of about 1.75 to 2.25 inches. This may shorten the operational time for buoyancy recovery as well as keep the buoyancy from having opportunity to float and collect together increasing the potential for buoyancy blockage of the riser, or bridging.

In one or more embodiments, the internal diameter may be on the order of 2.2× (or greater) the largest buoyancy element diameter when mixed buoyancy element size is used. In such embodiments, the internal diameter of the riser system may be 2.00 to 4.00 inches, or may be 2.50 to 3.50 inches. For a riser system to recover mixed buoyancy element sizes or parallel buoyancy elements a >1.6 ratio of transfer fluid to buoyancy element volume may manage potential bridging and plugging the riser. Coupled with the internal diameter of the riser system, this may shorten the operational time for buoyancy recovery as well as reduce the potential for blockage within the riser system.

Although only a few example embodiments have been described in detail above, those skilled in the art will readily appreciate that many modifications are possible in the example embodiments without materially departing from embodiments disclosed herein. Accordingly, all such modifications are intended to be included within the scope of this disclosure as defined in the following claims.

What is claimed:

1. A system for removing rigid unconsolidated buoyancy material from a subsea facility, disposing rigid unconsolidated buoyancy material to the subsea facility, and recovering said rigid unconsolidated buoyancy material for reuse, the subsea facility comprising a buoyancy containment vessel, the system further comprising:

an inlet riser assembly fluidly connected to the side of the buoyancy containment vessel for injecting a mixture comprising seawater and the rigid unconsolidated buoyancy material laterally into the buoyancy containment vessel;

an outlet riser assembly fluidly connected to the top of the buoyancy containment vessel for recovery of the rigid unconsolidated buoyancy material vertically from the buoyancy containment vessel;

one or more exit ports providing fluid communication between an external environment and the internal volume of the buoyancy containment vessel;

a separation unit located on a workboat or a host facility for separating the rigid unconsolidated buoyancy material from seawater;

wherein the outlet riser assembly fluidly connects the buoyancy containment vessel to the separation unit.

2. The system of claim 1, wherein the buoyancy containment vessel has a conical top.

3. The system of claim 1, further comprising one or more guides located within the buoyancy containment vessel configured to route the rigid unconsolidated buoyancy material to a top outlet of the buoyancy containment vessel.

4. The system of claim 1, wherein the rigid unconsolidated buoyancy material comprises a plurality of macrospheres of a common shape and overall diameter.

5. The system of claim 1, wherein the rigid unconsolidated buoyancy material comprises a plurality of macrospheres having different overall diameters.

6. The system of claim 1, wherein the inlet riser assembly has an internal diameter of 1.2 to 3.0 times a largest diameter of the rigid unconsolidated buoyancy material.

7. The system of claim 1, wherein the outlet riser assembly has an internal diameter of 1.2 to 3.0 times a largest diameter of the rigid unconsolidated buoyancy material.

8. The system of claim 1, further comprising a pump for pumping a mixture of seawater and rigid unconsolidated buoyancy material down the inlet riser assembly and into the buoyancy containment vessel.

9. The system of claim 1, further comprising a venturi assembly fluidly connected between an outlet of the buoyancy containment vessel and the outlet riser assembly.

10. A method of performing subsea well operations, the method comprising:

installing a subsea facility;

fluidly connecting the subsea facility directly or indirectly to a subsea well system;

transferring fluid to or from the subsea facility and the subsea well system; and recovering the subsea facility;

wherein the installing comprises sinking the subsea facility and lowering the subsea facility to the seafloor, adjusting an amount of rigid unconsolidated buoyancy material in at least one buoyancy containment vessel to increase or decrease a buoyancy of the subsea facility or portion thereof, and landing the subsea facility on the seafloor, and wherein the recovering comprises adjusting the amount of rigid unconsolidated buoyancy material in the at least one buoyancy containment vessel to increase the buoyancy of the subsea facility or portion thereof, and raising the subsea facility from the seafloor.

11. The method of claim 10, wherein the adjusting comprises mixing seawater and unconsolidated buoyancy material, flowing an amount of the unconsolidated buoyancy material into the at least one buoyancy containment vessel to increase the buoyancy, and flowing an amount of unconsolidated buoyancy material out of the buoyancy containment vessel to decrease the buoyancy, wherein the amount of unconsolidated buoyancy material flowing into and out of the buoyancy containment vessel is counted by one or more sensors.

12. The method of claim 11, wherein a velocity of the volume of seawater is greater than a terminal velocity of the rigid unconsolidated buoyancy material in a static water column.

13. The method of claim 11, wherein the unconsolidated buoyancy material has a diameter in the range of 0.50 to 5.00 inches.

14. The method of claim 11, further comprising adding a viscosity increasing agent to the seawater.

15. The method of claim 14, further comprising mixing the viscosity increasing agent with additional seawater in the buoyancy containment vessel.

* * * * *